United States Patent [19]

Smith

[11] 4,295,483

[45] Oct. 20, 1981

[54] CRUTCH-MOUNTED ACCESSORY POUCH

[76] Inventor: Samuel W. Smith, P.O. Box 317, Anthony, Fla. 32617

[21] Appl. No.: 106,007

[22] Filed: Dec. 26, 1979

[51] Int. Cl.[3] ..... A61H 3/02

[52] U.S. Cl. ..... 135/66; 135/68

[58] Field of Search ..... 182/65, 66, 68, 69; 150/34

[56] References Cited

U.S. PATENT DOCUMENTS

| | | | |
|---|---|---|---|
| 501,728 | 7/1893 | Nathan | 150/34 |
| 2,210,493 | 8/1940 | Lisi | 135/66 |
| 2,311,049 | 2/1943 | Hedden | 135/68 |
| 2,423,635 | 7/1947 | Blum | 135/68 |
| 3,985,148 | 10/1976 | Cadman | 135/66 |
| 4,027,687 | 6/1977 | McGowan | 135/68 |
| 4,146,045 | 3/1979 | Grant | 135/68 |

*Primary Examiner*—Reinaldo P. Machado

[57] ABSTRACT

An accessory pouch mounting upon a crutch, having a central cavity for the portage of small articles, and having attached exterior pockets to carry additional items separately, and having attached exterior loops to which larger bundles may be tied for portage. A snugly fitting fabric envelope surrounds the side members of a common Y-type crutch and a fabric bottom in the fabric envelope closes the lower portion of the accessory pouch thus formed with a trouser-like fit against the side members of a common Y-type crutch. A pair of binding posts pass through holes in the upper portion of the fabric envelope, and locate in the standard handle adjustment holes provided in the side members of a common Y-type crutch, thereby securing the accessory pouch against relative movement or slippage upon the Y-type crutch. The crutch-mounted accessory pouch provides for the portage of accessory items and small burdens by lame or handicapped persons without encumberance of the hands, and in addition to or instead of such portage by handbags, or pockets in clothing.

2 Claims, 8 Drawing Figures

FIG. 6
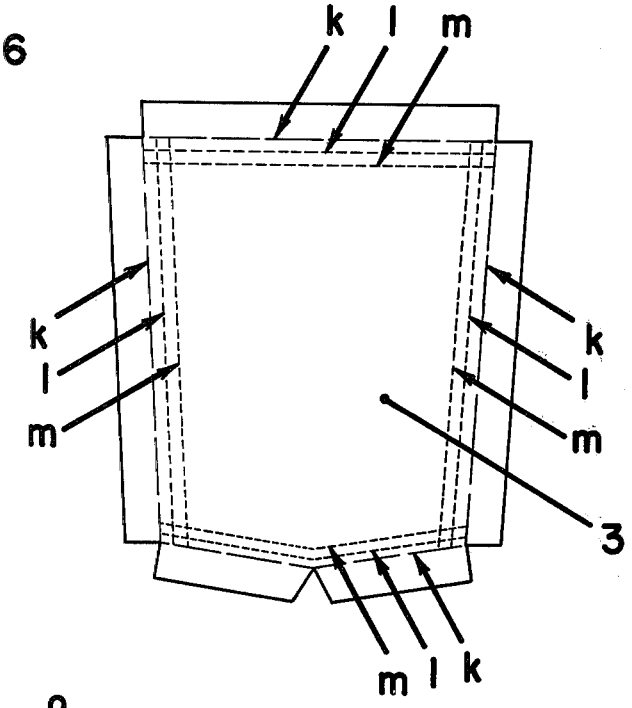
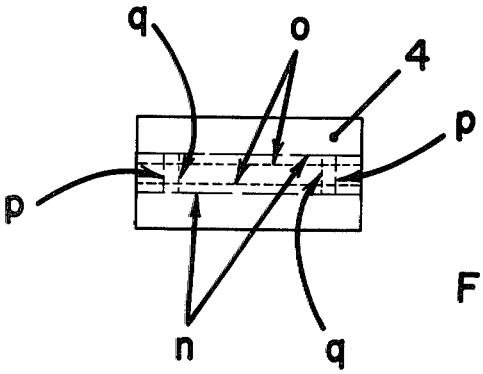
FIG. 7
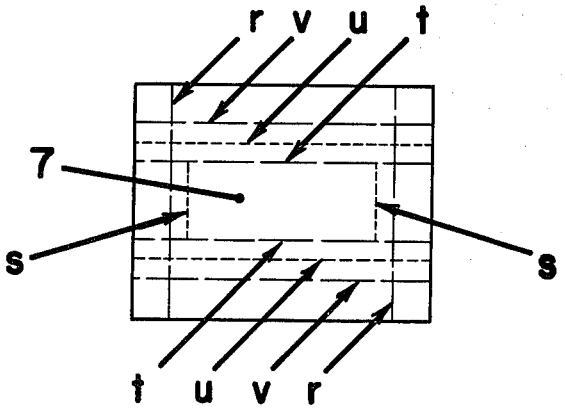
FIG. 8

CRUTCH-MOUNTED ACCESSORY POUCH

FIELD OF THE INVENTION

The invention relates to an accessory pouch mounting upon a crutch, and permitting the portage of accessory items and small burdens by lame or handicapped persons without encumberance of the hands; and particularly to an accessory pouch mounting upon a common Y-type crutch on the side members of such a crutch and below the handle of such a crutch; and even more particularly to a snugly fitted fabric envelope held securely in place by binding posts and having a central cavity for the storage of articles between the side members of a common Y-type crutch, and having attatched exterior pockets to carry additional items separately, and having attatched exterior loops to which additional small burdens may be tied, and having in the aforementioned central cavity a fabric bottom closure conforming to the structure of a Y-type crutch with a trouser-like fit, and the whole of the structure being so contrived as to be easily fitted to and removeable from a common Y-type crutch.

BACKGROUND OF THE INVENTION

Many bags and pouches have been devised for the portage of small items. Many of such have had exterior pockets which permit items to be held separate, and many of such bags or pouches have been provided with loops, or rings, or grommets by means of which additional bundles or packages may be attatched. However, most of these prior devices have been devised to be hand-held, as in ladies' handbags, or mounted upon the back or body, as in campers' backpacks or camera cases, or carried upon the waist belt, as in money purses, tobacco pouches or electronic calculator cases. Moreover, the use of pockets, rings, and loops in clothing generally, and outdoor survival-type clothing especially, is well known.

However, none of the said devices have been so devised as to permit a lame or handicapped person to transport small burdens, accessory items, and miscellanious small articles at will in safety and convenience, and with the hands and body unencumbered; and none of the said devices has been devised to employ a common crutch in a carry-all capacity to that end, as none of the said devices here described have been devised to be mounted upon a common crutch.

Heretofore, a lame or handicapped person, being often seated or wheelchair borne, would frequently find it difficult, inconvenient, or uncomfortable to make use of trouser pockets, especially back pockets. Additionally, a woman would encounter the difficulty of attempting the management of a handbag or purse while using crutches. Handbags hinder balance and mobility in that they tend to swing freely and catch against nearby objects such as tables, chairs, or even persons of immediate proximity.

School children further find it difficult to transport school books and supplies, and are even more likely to be overbalanced by an unwieldly burden. The usual expedient of strapping together schoolbooks and tying them directly to a handle of a crutch is disadvantageous in that the presence of such a dangling strap makes the manual retention of the crutch during use quite difficult and unreliable.

OBJECTS OF THE INVENTION

Therefore the need has arisen for a means by which a lame or handicapped person could transport small burdens, accessory items, and miscellanious articles without encumberance of the hands; without the recourse of tying a burden directly to a crutch handle; and without the exclusive recourse to often inconvenient, or uncomfortable, clothing pockets or belt or body packs. Such a device should provide increased safety and convenience for a lame or handicapped person; such a device should be devised of simple and inexpensive construction, and of common materials assembled by uncomplicated processes; such a device should provide a sufficient degree of storage, singly or when used in pairs, to accomodate the usual pocket contents of an average person; such a device should be provided with compartmentalized storage capacity for the orderly distribution and separation of small articles; such a device should provide for the optional attatchment of additional burdens such as schoolbooks or shopping bags; such a device should be securely and compactly mountable upon a common crutch of conventional manufacture; such a device should be attractive in appearance and without sharp edges or large projections. These objectives, and other objectives which may be discernable from examination of the accompanying drawing, are obtained by the device of the invention, which may be generally described as a crutch-mounted accessory pouch having a fabric envelope body with pockets and loops upon the exterior thereof, and having a fabric bottom closure, and which device is secured in position upon a common Y-type crutch by a snug fit and binding posts attatching the fabric envelope body to the side members of the Y-type crutch.

BREIF DESCRIPTION OF THE DRAWING

A preferred embodiment—illustrative of the best mode in which the applicant has contemplated applying the principal—is shown in the accompanying drawing, and is clearly and distinctly pointed out and set forth in the appended claims.

FIG. 6 is a pattern for the exterior pocket (3) showing the relative placement of folds and stitchings employed in the construction and attatchment thereof.

FIG. 7 is a pattern plan for the exterior loop (4) showing the relative placement of folds and stitchings employed in the construction and attatchment thereof.

FIG. 8 is a pattern plan for the fabric bottom closure (7) showing the relative placement of folds and stitchings employed in the construction and attatchment thereof.

Similar numerals, and letters of similar case, refer to similar parts throughout the drawings.

DESCRIPTION OF THE PREFERRED EMBODIMENT

Figure 1:
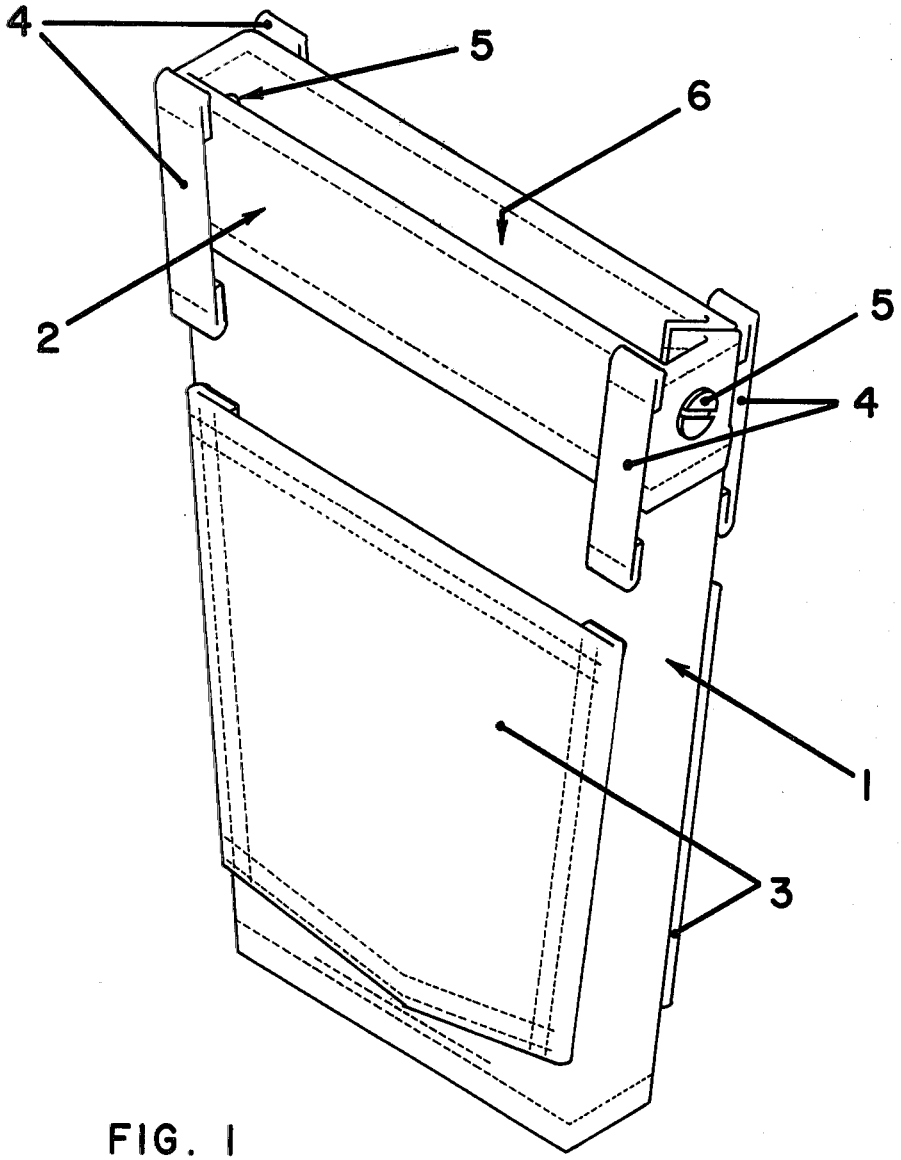
FIG. 1 is a perspective view of the device, unmounted, showing the structure in general and the structure of the open pockets (3) and loops (4) upon the exterior especially.
Figure 2:
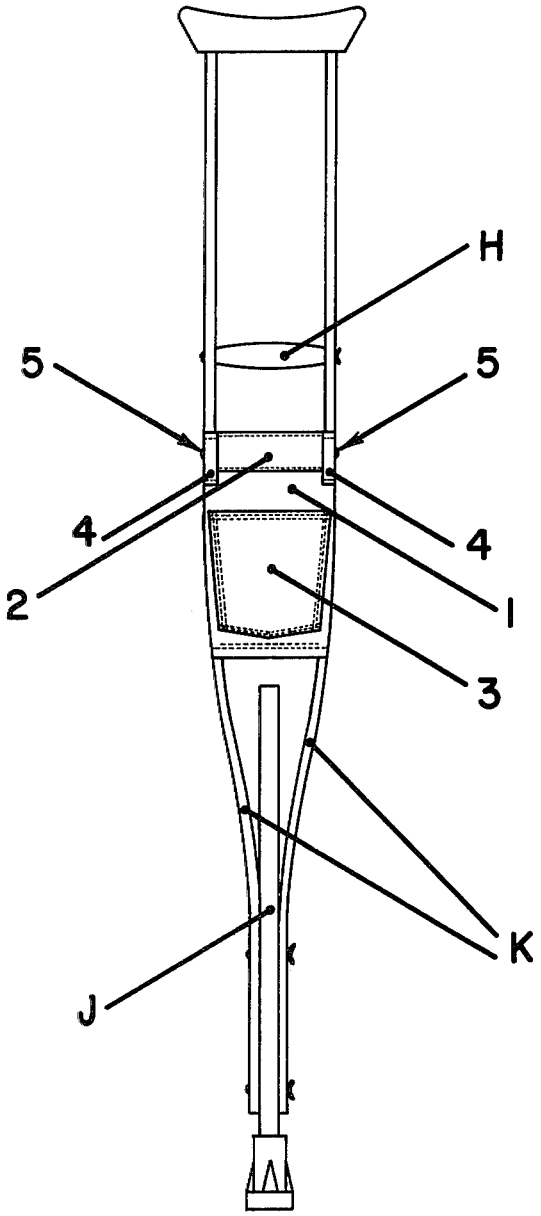
FIG. 2 is a plain side view of the device mounted upon a commmon Y-type crutch, as for use.

The device of the invention is shown generally in FIG. 2 and more particularly in FIG. 1 and comprises in combination a crutch and an accessory pouch mounting thereupon, with the pouch having a generally trapezoidal shape and a generally rectangular section closely fitting around the middle portion of the crutch as shown in FIG. 2, and further having open clothing-type pockets (3) and fabric loops (4) upon the exterior surface of the fabric envelope body (1) which incorporates an integral top band (2).

Figure 5:
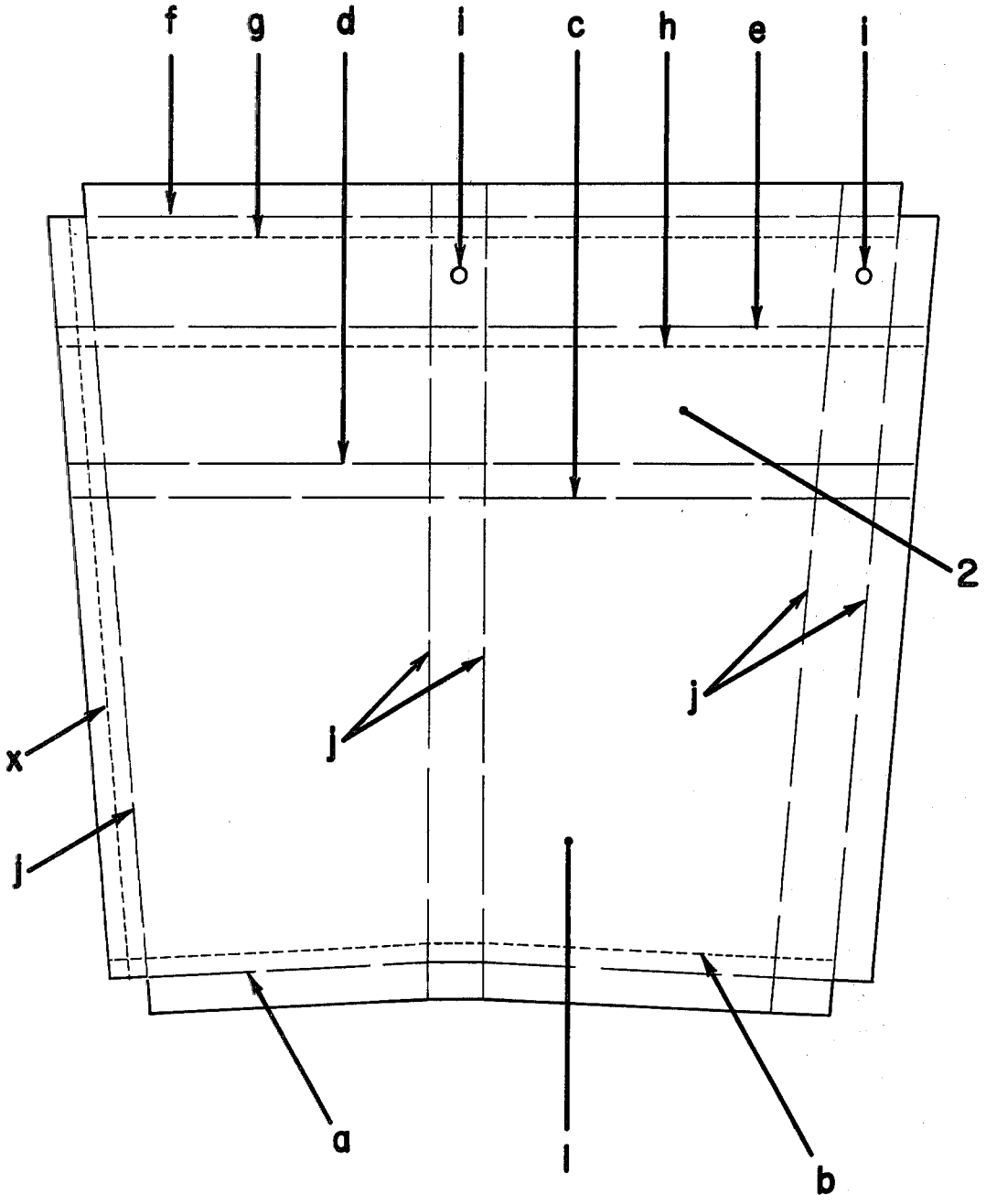
FIG. 5 is a pattern plan for the fabric envelope body (1) incorporating the integral top band (2), showing the relative placement of folds and stitchings employed in construction thereof.

The manufacture of the device of the invention may be readily accomplished with conventional sewing processes and inexpensive materials. A pattern for the fabric envelope body (1) incorporating an integral top band (2) is cut as shown in FIG. 5 from a piece of fabric such as denim cloth or khaki cloth or similar materials such as vinyl plastic, nylon, or leather. The lower edge of the pattern of FIG. 5 is turned exterior side up and then is turned under on line (a) of FIG. 5 and sewn along line (b) of FIG. 5 to form a lower edge hem.

The integral top band (2) is next formed by turning the material up on line (c) of FIG. 5, then back on line (d) of FIG. 5, then under on line (f) of FIG. 5 and under again on line (e) of FIG. 5, thus bringing five layers of material together to be sewn simultaneously by stitching along line (g) of FIG. 5. The resulting integral top band (2) thus formed may be readily discerned with reference to FIG. 3. The line (h) of FIG. 5 is then sewn to reinforce the top edge of and complete the integral top band (2) of the fabric envelope body (1) of FIG. 1.

The pattern of FIG. 5 is then laid aside, and the pattern of the pocket (3) is cut as in FIG. 6. Laid exterior side up, the pattern of FIG. 6 is then turned under along each line (k) of FIG. 6, and sewn along each like (1) of FIG. 6, thus forming the exterior pocket (3) of FIG. 1 ready for attatchment. Two such pockets (3) are prepared, and set aside.

The exterior loop (4) is formed next from a pattern cut as shown in FIG. 7, which is laid exterior side up and then turned under along each line (n) of FIG. 7 and sewn along each line (o) of FIG. 7. Four such pieces are prepared, and set aside.

Figure 4:
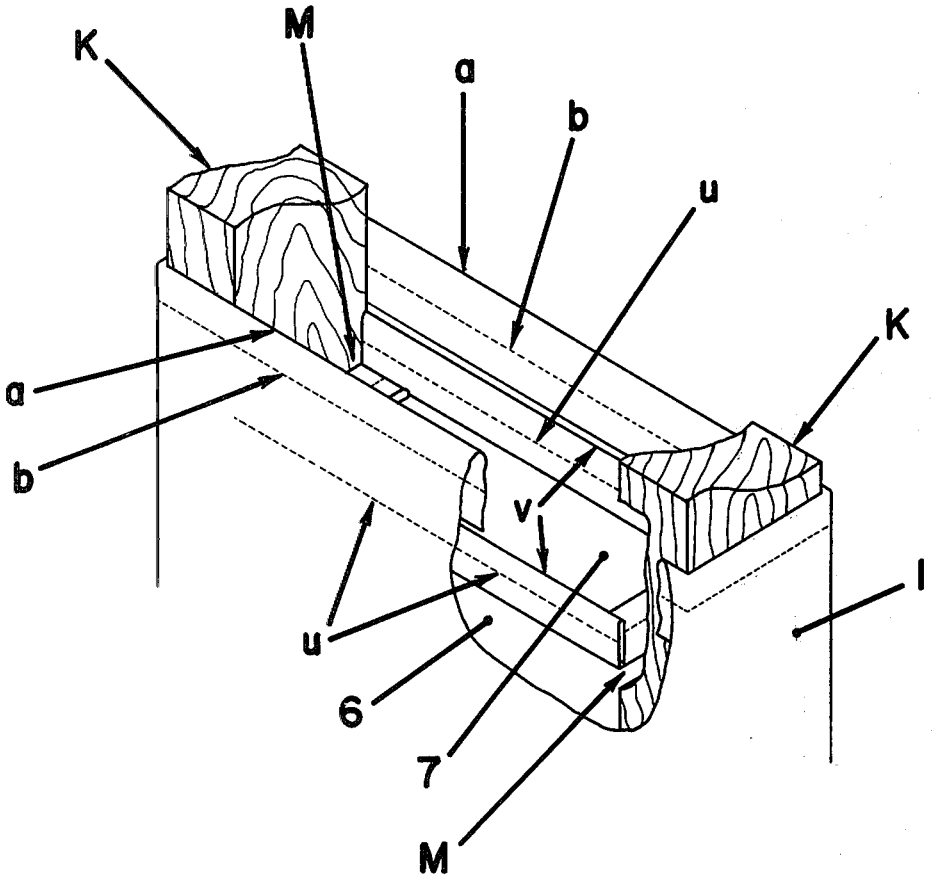
FIG. 4 is an inverted and cutaway perspective detail view of the device, showing the structure of the fabric bottom closure (7), means of attatching same, and the relative location of the fabric bottom closure (7) at the base of the central cavity (6) of the device and between the vertical members (K) of the Y-type crutch, thusly providing a trousers-like fit therebetween.

The fabric bottom closure (7) is next prepared from a pattern cut as shown in FIG. 8, which is laid exterior side up and then turned under along each line (v) of FIG. 8 and sewn along each line (u) of FIG. 8. Each line (r) of FIG. 8 is then turned under, and each line (s) of FIG. 8 is then sewn. Optionally, to facilitate hand sewing, the corner portions of the pattern of FIG. 8 bounded by lines (t) and (r) of FIG. 8 may be removed prior to folding or sewing. Like wise the lines (u) of FIG. 8 may remain unsewn until the actual attatchment of the fabric bottom closure (7) to the fabric envelope body (1) as shown in FIG. 4, especially in the case of factory or mass production.

The prepared pockets (3) are next attatched to the prepared fabric envelope body (1) as shown in FIG. 1 by orienting them exterior side up on the exterior side of the prepared fabric envelope body (1) in the two largest areas bounded by the lines (j) of FIG. 5 witn the lowermost point of each pocket (3) about a half-inch above the line (b) of FIG. 5. Each pocket is then attatched by sewing along each line (m) of FIG. 6. This completes the attatchment of the pockets (3) to the fabric envelope body (1) as shown in FIG. 1.

The four exterior loops (4) may be successively attatched to the prepared fabric envelope body (1) in the manner shown in FIG. 1 by locating a line (p) of FIG. 7 along line (e) of FIG. 5 with a line (n) of FIG. 7 along line (j) of FIG. 5 above an attatched pocket (3), and thereafter sewing along each line (q) of FIG. 7 to complete the attatchment of the exterior loops (4) to the fabric envelope body (1) and integral top band (2).

The fabric bottom closure (7) is next attatched to the fabric envelope body (1) in the manner shown in FIG. 4 by laying the prepared fabric envelope body (1) interior side up and placing the fabric bottom closure (7) interior side up thereupon with the line (u) of FIG. 8 centered just below the lowermost point of the pocket (3) attatched to the fabric envelope body (1) and with the line (u) of FIG. 8 further aligned parallel to the line (b) of FIG. 7 and with the remainder of the fabric bottom closure (7) projecting above line (a) of FIG. 5. The fabric envelope body (1) is then turned exterior side up and folded in half so that the outermost lines (j) of FIG. 5 are brought together in alignment, exterior sides together. Line (x) of FIG. 5 is then sewn, and the fabric envelope body (1) is thus caused to adopt an interior-side out tubular form. The fabric envelope body (1) is then turned exterior-side out, and the free side of the fabric bottom closure (1) is seized and turned up so that the line (u) of FIG. 8 may be brought into the orientation previously described below the lowermost point of the remaining pocket (3) attatched to the opposite side of the fabric envelope body (1), and sewn with the interior side of the fabric bottom closure (7) adjacent to the interior side of the fabric envelope body (1). This completes the attatchment of the fabric bottom closure (7) to the fabric envelope body (1) as shown in FIG. 4.

Figure 3:
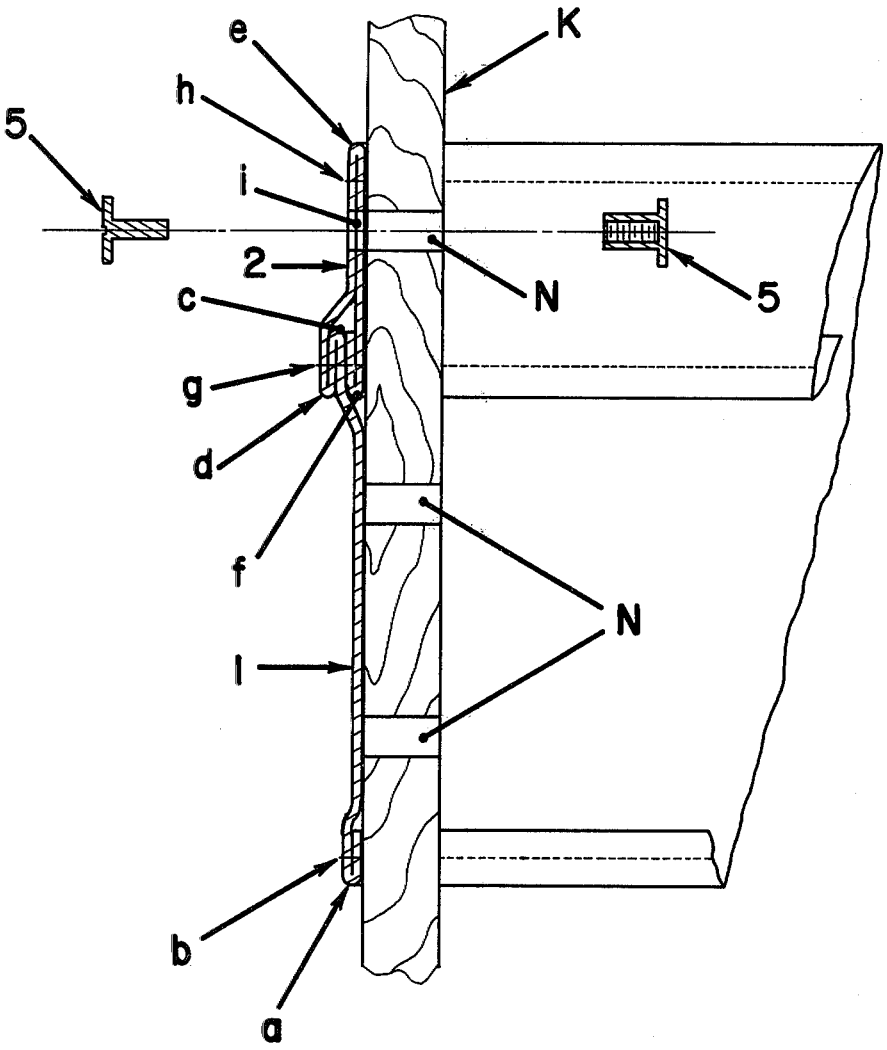
FIG. 3 is an expanded and sectional detail view of the device, showing the structure of the mounting means (5) and the order of folds and stitchings employed in the construction of the fabric envelope body (1) incorporating the integral top band (2).

The fabric envelope body (1) with integral top band (2) is then pierced in the positions indicated by holes (i) of FIG. 5 to a diameter equal to that of the holes (N) in the vertical members (K) of the Y-type crutch, and a pair of common binding posts (5) as shown in FIG. 1 and FIG. 3 are placed in a pocket (3) for convenient storage and until such time as the completed device is mounted for use upon a crutch.

The binding posts (5) are of standard manufacture, being of aluminum and having a one-half inch shank length and a 3/16ths inch female shank diameter, preferably.

OPERATION OF THE INVENTION

The device of the invention may be mounted readily upon a common Y-type crutch of standard manufacture in the fashion shown in FIG. 2, by first removing the handle (H) of FIG. 2 and the adjustable foot member (J) of FIG. 2, and then inserting the two vertical members (K) of FIG. 2 into the central cavity (6) of FIG. 1 and thence through the holes (M) of FIG. 4. The device is then drawn upward on the crutch until the two holes (i) of FIG. 5 are in alignment with the desired handle adjustment holes (N) of FIG. 3, and the binding posts (5)

of FIG. 3 are inserted and tightened, as shown in FIG. 2. The second such handle adjustment hole (N) below the location of the handle (H) of the crutch is usually the most convenient position for the device to be attatched, as shown in FIG. 2.

The handle (H) is then replaced in position, as is the adjustable foot member (J), as shown in FIG. 2, and the device is ready for use.

In use, the pockets (3) of FIG. 1 and FIG. 2 may be filled with various small articles such as wallets, checkbooks, pens, pencils, small flashlights, makeup compacts, key rings or keycases, prescription medicines, tissues or handkerchiefs, lipsticks or other miscellanious articles normally carried in pocket or purse, as may be filled the central cavity (6) of FIG. 1. The crutch may be used normally, and the pouch and contents are conveniently at hand, without encumberance of the person using the crutches.

In practise, the crutches may be repeatedly laid horizontal without the loss of articles from either the pockets (3) or the central cavity (6) of the device.

Additionally, small burdens such as shopping bags, schoolbooks, or handbags may be attatched by ties to the loops (4) upon the exterior of the fabric envelope body (1) of FIG. 1. Best attatched on the side of the crutch away from the body, additional burdens may be anchored so that they may be transported without undue swing and with safety and convenience.

The device may be easily removed from the crutch to be cleaned at desired intervals, and easily replaced thereafter.

BROADENING PARAGRAPH

The slight convexity of the vertical side members (K) of the crutch, combined with the straight-sided manufacture of the fabric envelope body (1) as shown in FIG. 1, results in a firm and snug fit of the device upon the crutch, and the use of the binding posts (5) as shown in FIG. 2 is optional unless extra burdens are to be carried by means of the exterior loops (4) of FIG. 1.

The exterior loops (4) of FIG. 1 are located in alignment to the vertical side members (K) of the crutch as shown in FIG. 2 in order to minimise deflection of the integral top band (2) of FIG. 1 under loadings imposed by additional burdens anchored to the loops (4) of FIG. 1. Further, the separation of the loops (4) as shown in FIG. 1 provides for a two-point anchorage of burdens to minimize swing and sway of burdens during transport.

In the case of a short person, using the crutches adjusted to minimum length, the uppermost tip of the adjustable foot member (J) of FIG. 2 may be cut away as necessary to prevent interference with the fabric bottom closure (7) of FIG. 4 as shown in FIG. 2.

The device may be manufactured in variations including zippered pockets and central cavity, or with expandable pouch pockets with only minor modification. The device may likewise be made from leather pieces assembled with laces, and laced to the crutch upon which it is mounted. Metal snap rings may be used in addition or instead of fabric loops to anchor burdens, and rivits may conceivably be used to fasten the device to a crutch permanantly.

The similarities of the device of the invention visually to bluejeans-type clothing is marked and may be put to good effect. The device may be decorated with stylish stitchings, elaborate pockets, and labels, and thus becomes a handsome accessory for women or men. The device may also be decoratively fringed.

Further, the device serves to disguise the crutch upon which it is mounted, minimising the utilitarian appearance of the crutch as an instrument of lameness, and thereby fostering an improved mental and emotional attitude not only in the user but in the non-handicapped persons with whom he associates. There is noticeably less ostriciszation of the handicapped person by his peers and strangers, and there is also less withdrawal on the part of the handicapped person from social interaction when provided with one or more devices of the invention.

This results in a more positive attitude in the handicapped individual, and may be generally accepted to promote faster and more complete healing, as in the case of a broken limb or other trauma.

It will be obvious to one skilled in the art that various changes may be made in the described embodiment of the invention without departing from the spirit and scope thereof and therefore the invention is not limited by that which is illustrated in the drawing and described in the specification, but only as indicated in the accompanying claims.

I claim:

1. In combination a pouch means and a Y-type crutch having two separate upright side members, with said pouch means comprising a fabric envelope body means fitting around a central portion of said crutch means, and with said pouch means comprising a fitted bottom closure means extending the width of the lower portion of said pouch means and the distance between the said upright side members of the said crutch means, and said pouch means comprising a central cavity within said side member means of said crutch means and said fabric envelope body means whereby small articles may be transported therewithin without loss.

2. A pouch means such as (1) comprising a pair of hole means in the upper portion of the fabric envelope means and further comprising a pair of screw means fastener means fitting into said hole means and into crutch means whereby the said pouch means may be securely retained in place upon the said crutch means.

* * * * *